US008840409B2

(12) United States Patent
Ikeda et al.

(10) Patent No.: US 8,840,409 B2
(45) Date of Patent: Sep. 23, 2014

(54) LEVER-EQUIPPED CONNECTOR UNIT

(75) Inventors: Tomohiro Ikeda, Kakegawa (JP); Ryuta Takishita, Kakegawa (JP); Kouichiro Mochizuki, Kakegawa (JP); Teruhiko Ohike, Kakegawa (JP); Sho Nogashira, Kakegawa (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 13/561,026

(22) Filed: Jul. 28, 2012

(65) Prior Publication Data

US 2013/0035004 A1 Feb. 7, 2013

(30) Foreign Application Priority Data

Aug. 1, 2011 (JP) ..... 2011-168255

(51) Int. Cl.
*H01R 13/62* (2006.01)
*H01R 13/629* (2006.01)

(52) U.S. Cl.
CPC ..... *H01R 13/62938* (2013.01)
USPC ..... 439/157

(58) Field of Classification Search
USPC ..... 439/822, 157, 372
See application file for complete search history.

(56) References Cited

U.S. PATENT DOCUMENTS

| | | | | |
|---|---|---|---|---|
| 7,445,491 | B2 * | 11/2008 | Fujii et al. | 439/489 |
| 7,959,451 | B2 * | 6/2011 | Tonosaki | 439/157 |
| 8,297,992 | B2 * | 10/2012 | Park | 439/157 |
| 2009/0117770 | A1 | 5/2009 | Fukui et al. | |

FOREIGN PATENT DOCUMENTS

| | | | |
|---|---|---|---|
| CN | 101471510 | A | 7/2009 |
| CN | 101682145 | A | 3/2010 |
| CN | 201868679 | U | 6/2011 |
| JP | 2009-110896 | A | 5/2009 |
| WO | WO 2010035247 | A2 * | 4/2010 |
| WO | WO-2010035247 | A2 | 4/2010 |

OTHER PUBLICATIONS

Liu, Ya-hua, Notification of First Office Action, CN 201210272324.1, issued Apr. 30, 2014, 16 pages, The State Intellectual Property Office of the People's Republic of China, Beijing, China.

* cited by examiner

*Primary Examiner* — Neil Abrams
*Assistant Examiner* — Travis Chambers
(74) *Attorney, Agent, or Firm* — Edwards Wildman Palmer LLP; James E. Armstrong, IV; Jonathon P. Western

(57) ABSTRACT

The prevent invention provides a lever-equipped connector unit, which comprises a housing being capable of receiving a terminal; a lever rotatably coupled to the housing, and formed in a horseshoe shape; and a counter housing engageable with the housing, wherein the lever has a pair of arm plates configured to sandwich the housing and having a cam portion therein, wherein the counter housing has a peripheral wall engageable with the housing, and a pair of driven pins being slidably engageable with the cam portion and formed in the both outer surfaces of the peripheral wall, and wherein the housing engages with the counter housing as the driven pin proceeds into the cam portion, and the lever rotates from its stand-by state.

4 Claims, 5 Drawing Sheets

LEVER-EQUIPPED CONNECTOR UNIT

1. FIELD OF THE INVENTION

The present application claims priority of Japanese Patent Application No. 2011-168255 filed on Aug. 1, 2011, the disclosure of which is expressly incorporated by reference herein in its entirety.

The invention relates to a lever-equipped connector unit in which a housing approximates a counter housing thereby causing the housing to engage with the counter housing, as a lever is rotated.

2. DESCRIPTION OF THE RELATED ART

Referring to FIGS. 4 and 5, a conventional lever-equipped connector unit is comprised of a connector 102, and a counter connector 103 into which the connector 102 is fitted. The counter connector 103 can be at least a part of an electric power circuit for supplying electric power from a battery into a load and being mounted to an electric vehicle. For more detail, see JP2009-110896 (A). FIG. 4 is a perspective view of a conventional lever-equipped connector unit. FIG. 5 is a side view of the conventional lever-equipped connector unit of FIG. 4.

Referring to FIG. 4, the connector 102 is comprised of a housing 104 receiving a terminal (not shown) therein, and a lever 105 which is rotatably attached or coupled to the housing 104. As the lever 105 rotates, the housing 104 is put close to the counter housing 107. As a result, the housing 104 can engage with or mate with the counter housing 107. The housing 104 is comprised of a rectangular-shaped substrate 141, and a first cylindrical wall 142 vertically extending from the substrate 141, a flange portion (not shown) extending from the edge of the first cylindrical wall 142 and being disposed in the interior of the first cylindrical wall 142, and a second cylindrical wall 144 having a inner diameter smaller than that of the first cylindrical wall 142.

The lever 105 is comprised of a pair of arm plates 151 configured to sandwich the housing 104 therebetween, and an operating portion 152 coupled to the pair of arm plates 151, and is formed in a horseshoe shape. Each of the arm plates 151 has a cam hole 153 with which each of driven pins 108 of the counter connector 103 can slidably engage. The cam hole 153 has an inlet or entrance into which the driven pin 108 can be inserted. The inlet or entrance has a frame-shaped reinforcing piece 154 communicating with both ends of the cam hole 153. The reinforcing piece 154 is formed in tip or end portion which is located away from the operating portion 152 of the pair of arm plates 151. In other words, the reinforcing piece 154 is formed in one end of the arm plate 151 adjacent to the counter housing 107 at a stand-by state in which the lever 105 is lifted up prior to the rotation of the lever 105. For more detail, see FIGS. 4 and 5.

Referring to FIG. 4, the counter connector 103 includes a counter housing 107 being capable of engaging with the housing 104, and a pair of the driven pins 108 projecting or extending from the outer surface of the counter housing 107 in a direction away from each other.

The connector 102 can be coupled to and fitted into the counter housing 107 or the counter connector 103 by passing or threading each of the driven pins 108 via each reinforcing piece 154 of the arm plate 151 into the cam hole 153, and rotating the lever 105 from its stand-by state so as to put the housing 104 close to the counter housing 107.

The above lever 105 is conventionally provided by formation. However, after the formation of the lever 105, the dimension between the tip portions of the pair of arm plates 151 is made less than the dimension between the center portions of the pair of arm plates 151. Due to this phenomenon, even if the housing 104 is put close to the counter housing 107, the pair of driven pins 108 of the counter connector 103 is impeded or hindered by the reinforcing piece 154 of the arm plate 151 without passing along the inside of the reinforcing piece 154. In other words, the lever 5 collapses inward. In the case of watertight lever-equipped connector unit, a watertight rubber stopper (not shown) is inserted into the second cylindrical wall 144 of the housing 104, and the inner peripheral lip of the watertight rubber stopper is in close contact with the outer periphery of the second cylindrical wall 144. In addition, the outer peripheral lip of the watertight rubber stopper is in close contact with the inner periphery of the counter housing 107. As such, the arm plate 151 of the lever 105 should be spaced at a desired distance or interval (L) from the outer surface of the housing 104, as shown in FIG. 5. Accordingly, the lever 105 has a tendency to collapse inward.

SUMMARY OF THE INVENTION

In view of the above, the invention presents several improvements in that the tip or end portion of the lever which has a tendency to collapse inward can be corrected, and the driven pin can smoothly proceed into the cam hole without being hindered or impeded by the tip or end portion of the lever.

In one aspect, the invention provides a lever-equipped connector unit, which includes a housing being capable of receiving a terminal; a lever rotatably coupled to the housing, and formed in a horseshoe shape; and a counter housing engageable with the housing. The lever has a pair of arm plates configured to sandwich the housing therebetween and having a cam portion therein. The counter housing has a peripheral wall engageable with the housing, and a pair of driven pins being slidably engageable with the cam portion and formed in the both outer surfaces of the peripheral wall. The housing engages with the counter housing as the driven pin proceeds into the earn portion, and the lever rotates from its stand-by state. The arm plate of the lever has a sliding portion formed in a tip or end portion of the lever which is situated in its stand-by state and extending toward the counter housing. The peripheral wall of the counter housing has a first guiding member thereon. The first guiding member is configured to slide the sliding portion of the arm plate which collapse inward thereon, as well as, to guide the sliding portion toward the outside of the peripheral wall.

Preferably, a tip or end portion of the guiding member is closer to the sliding portion than a shaft of the driven pin.

Preferably, the lever-equipped connector unit further comprises a second guiding member which is located in parallel to the first guiding member, wherein the inner surface of the arm plate is capable of sliding on the second guiding member.

Preferably, either of the first guiding member or the sliding portion has a tapered surface in its tip or end portion, or the second guiding portion has a tapered surface in its tip or end portion.

BRIEF DESCRIPTION OF THE DRAWINGS

The invention may be put into practice in various ways and a number of embodiments will be described by way of example to illustrate the invention with reference to the accompanying drawings, in which.

DETAILED DESCRIPTION OF THE PREFERRED EMBODIMENTS

Figure 1:
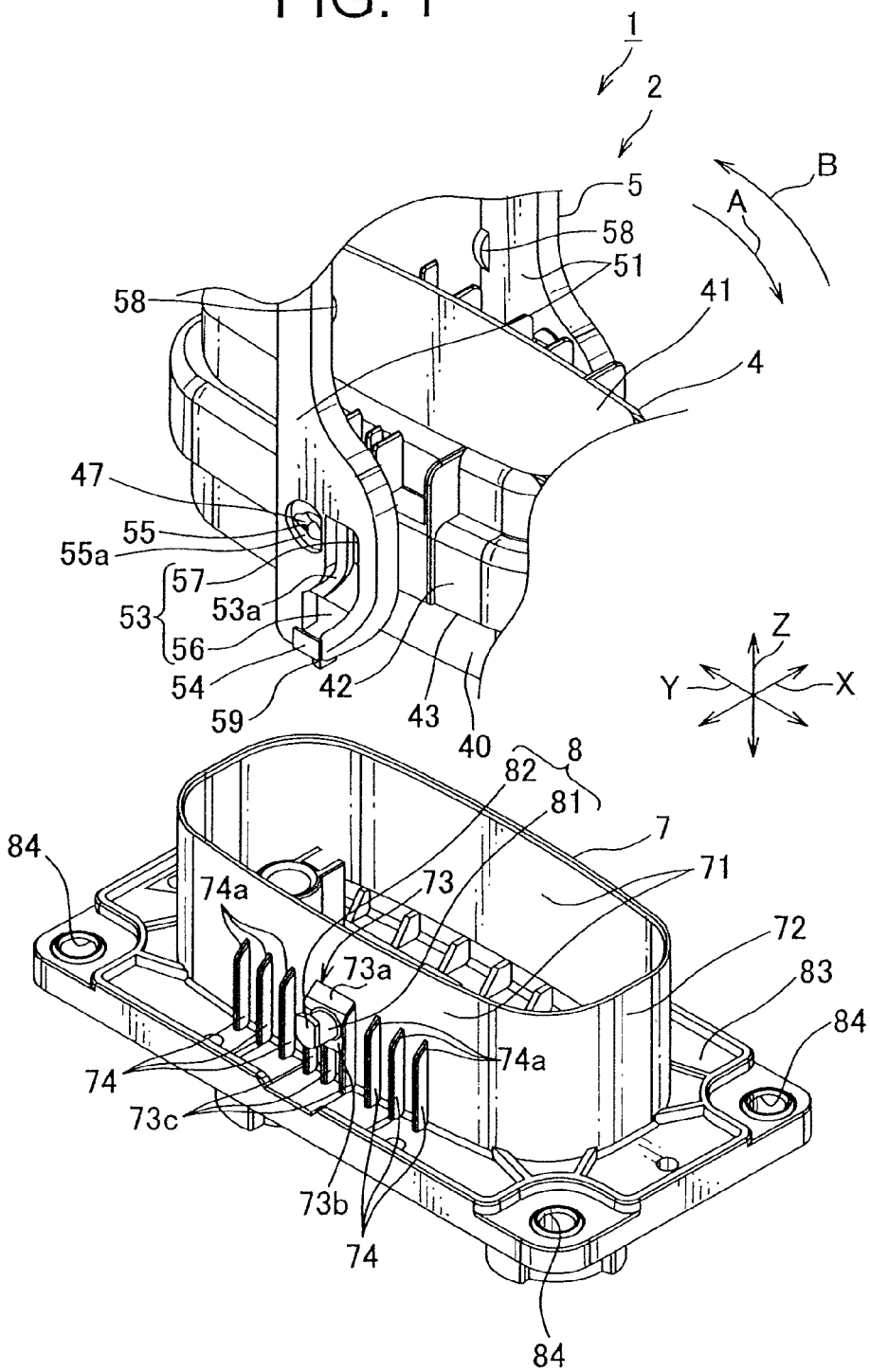
FIG. 1 is a cross-sectional view of an embodiment of a lever-equipped connector unit in accordance with the invention.
Figure 2:
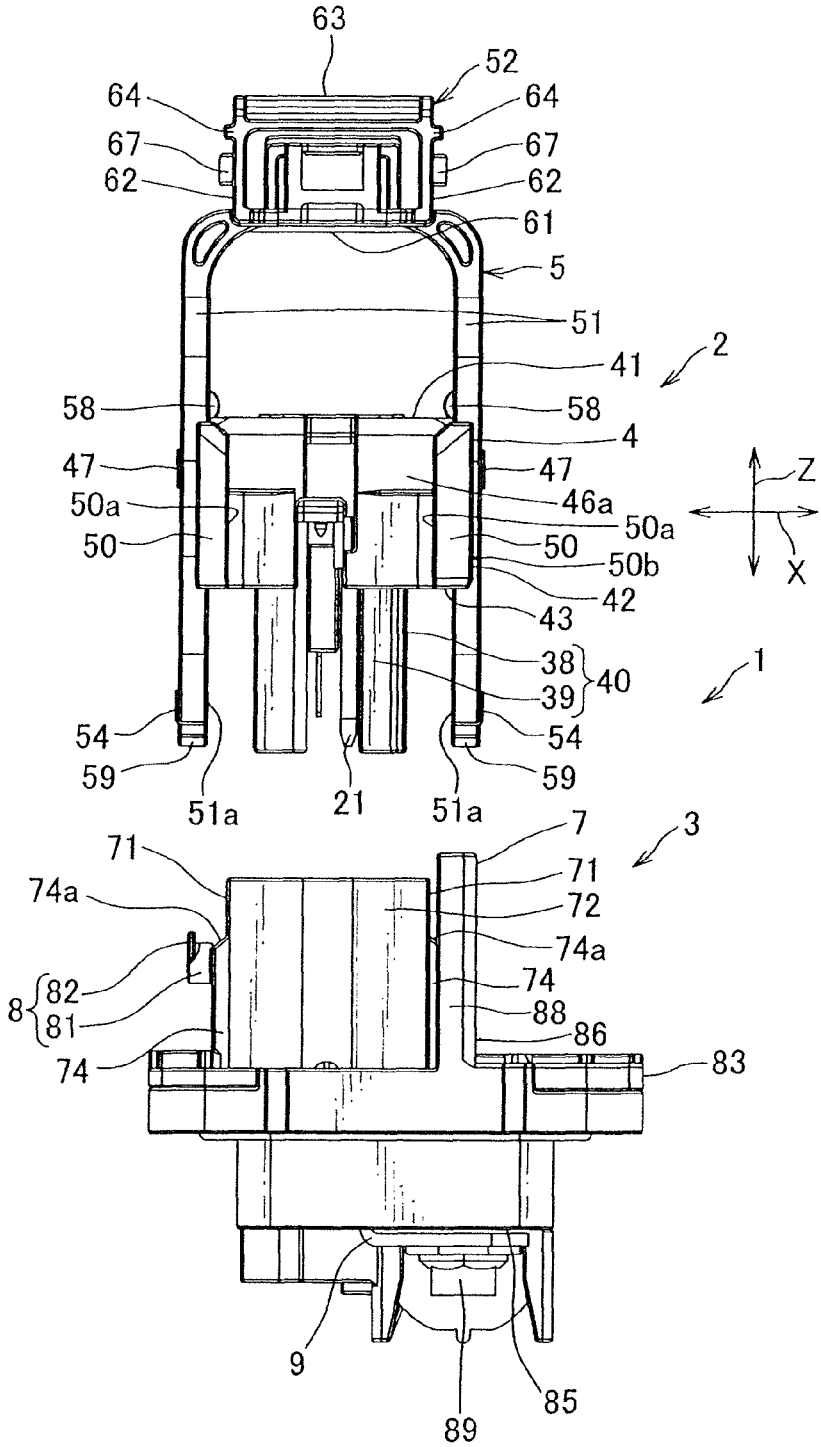
FIG. 2 is a side view of the lever-equipped connector unit of FIG. 1.
Figure 3:
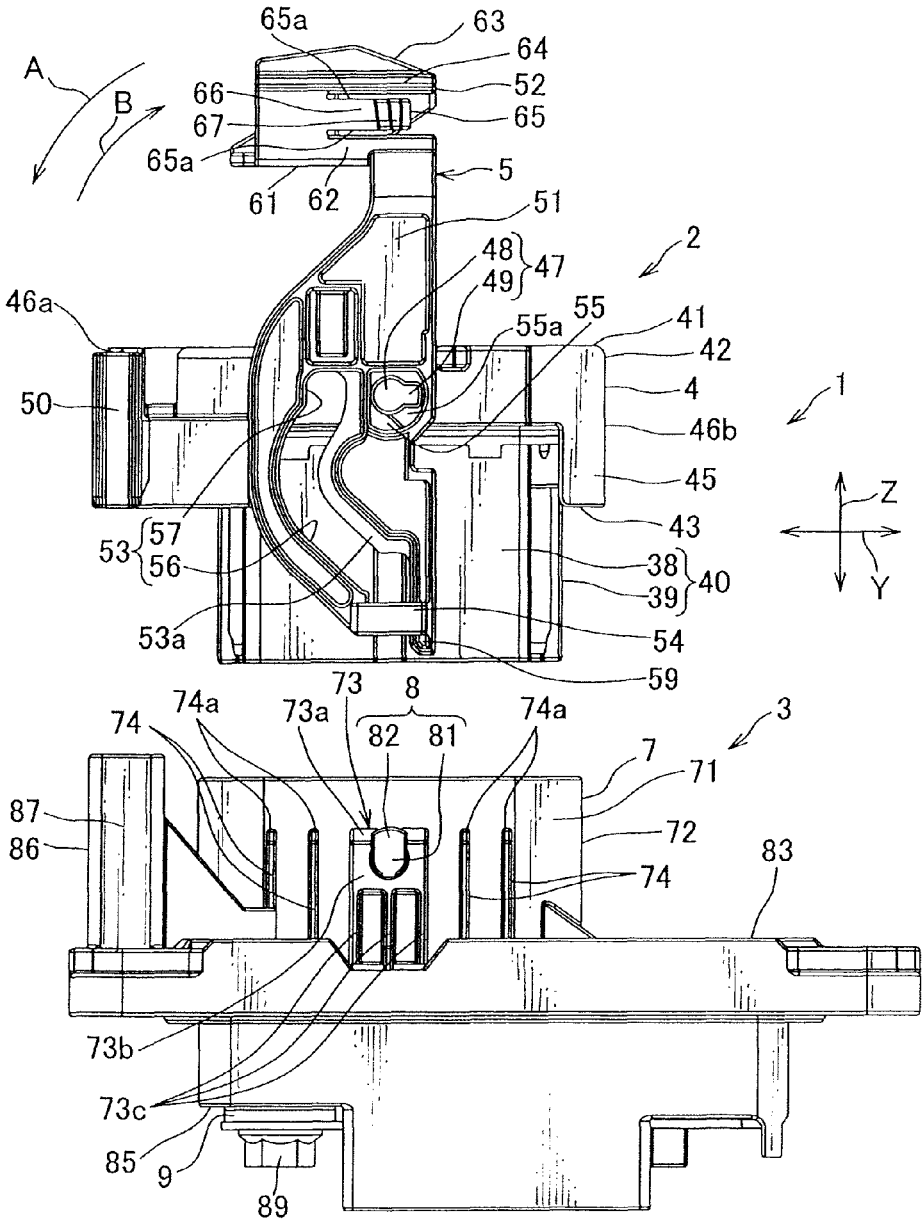
FIG. 3 is a side view of the lever-equipped connector unit of FIG. 1.
Figure 4:
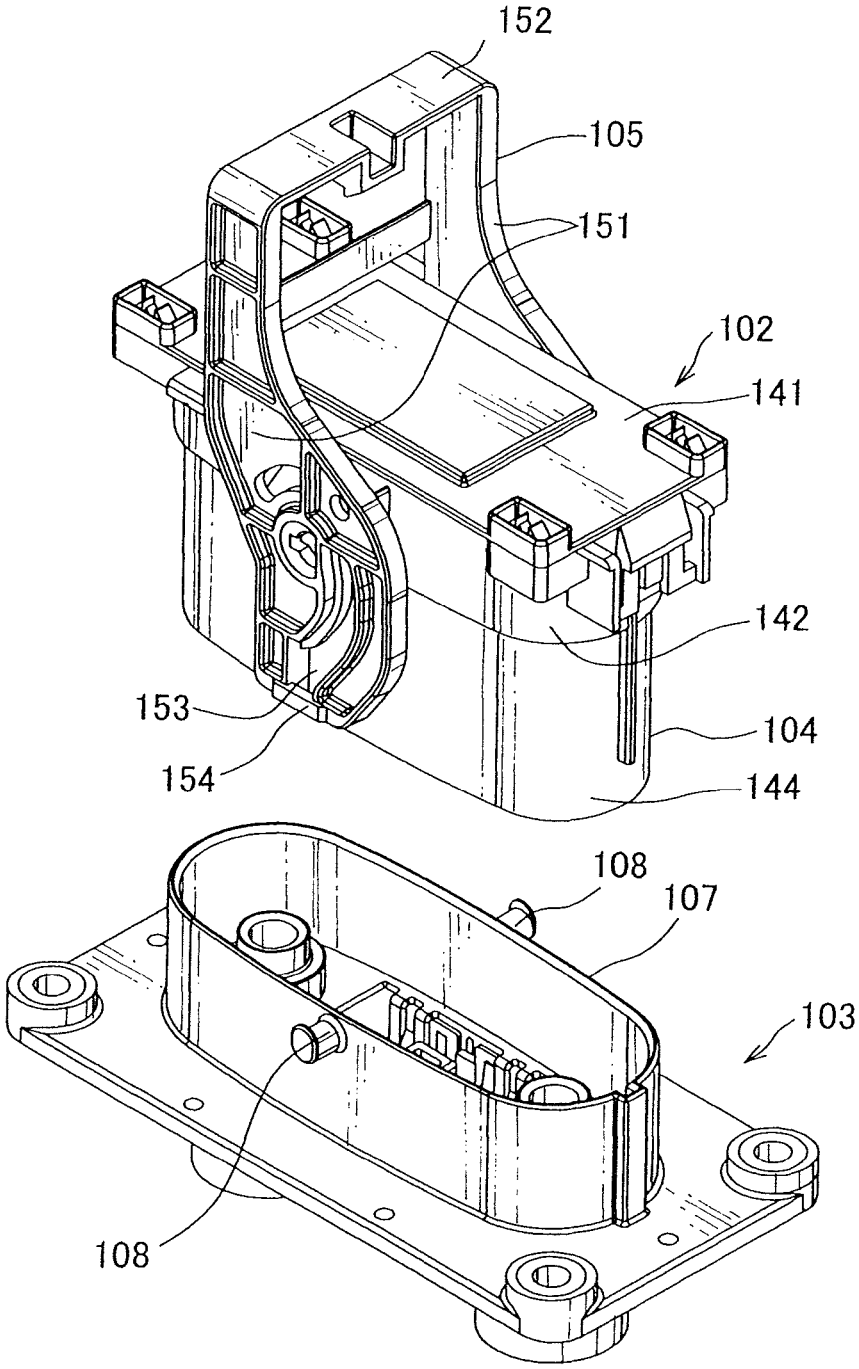
FIG. 4 PRIOR ART
FIG. 4 is a perspective view of a conventional lever-equipped connector unit.
Figure 5:
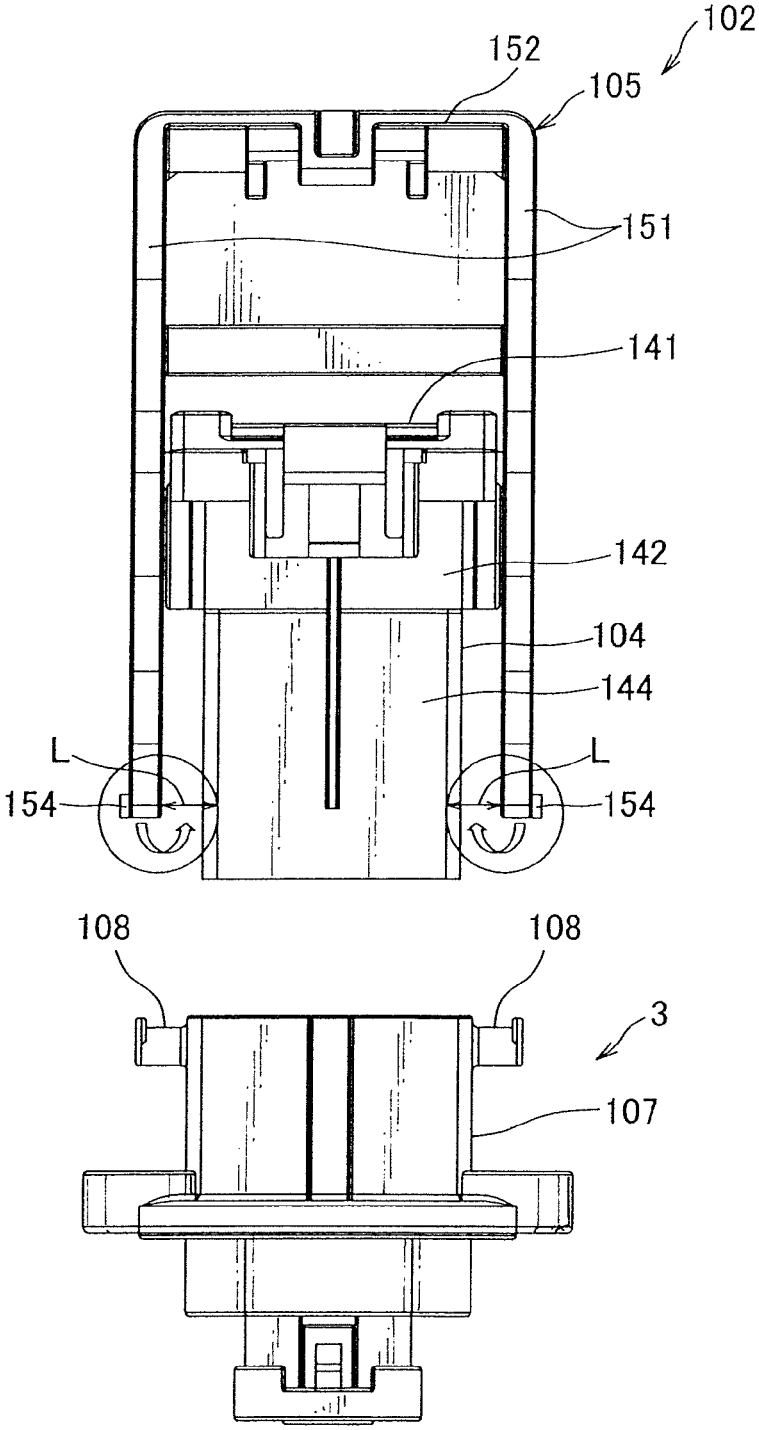
FIG. 5 PRIOR ART
FIG. 5 is a side view of the conventional lever-equipped connector unit of FIG. 4.

With reference to FIGS. 1-3, one embodiment of a lever-equipped connector unit in accordance with the invention will be hereinafter described in detail.

Firstly, referring to FIG. 1, a lever-equipped connector unit 1 has a connector 2 and a counter connector 3. The connector 2 is shown to include a terminal 21 as shown in FIG. 2, a housing 4 formed of insulating resin and configured to receive the terminal 21 therein, and a lever 56 rotatably coupled to the housing 4. The counter connector 3 is shown to include a counter housing 7 which the housing 4 can mate with, and a pair of driven pins 8 projecting from an outer surface of the counter housing 7 and being slidably engageable with a cam hole 53 formed in the lever 5. In FIGS. 1-3, the lever 5 is situated in its stand-by state in which an operating portion 52 is lifted up prior to the rotation of the lever 5. The connector 1 does not engage with or mate with the counter connector 3. In other words, the connector 1 and the counter connector 3 are not assembled in FIGS. 1-3.

The terminal 21 is connected to an electrical wire (not shown) by caulking. The terminal 21 may include a pair of male terminals. The pair of male terminals 21 is arranged in a direction as indicated by an arrow "Y" (i.e., a front-back direction).

Referring to FIGS. 1 and 2, the housing 4 has an oval substrate 41, a first cylindrical portion 42 substantially vertically extending from the peripheral edge of the substrate 41, a parallel plate 43 extending from the peripheral edge of the first cylindrical portion 42 and being parallel to the substrate 41, and a second cylindrical portion 40 substantially vertically extending from the peripheral edge of the parallel plate 43.

Throughout the specification, the direction in which the longest diameter of the oval substrate 41 extends can be defined by a front-back direction or Y direction; the direction in which the shortest diameter of the oval substrate 41 extends can be defined by a horizontal direction, left-right direction, or X direction; and the direction in which the housing 4 of the connector 2 engages or mates with the housing 7 of the counter connector 3 can be defined by a vertical direction or Z direction.

Referring to FIG. 3, the first cylindrical portion 42 can include a pair of first walls 45 which is spaced apart from each other, a pair of second walls 46*a*, 46*b* extending from the associated edge of the pair of the first wall 45, and a pair of rotation shafts 47 rotatably coupled to an annular hole 55 of the lever 5. The first wall 45 extends in front-back direction (i.e., Y direction).

Each of the second walls 46*a*, 46*b* extends in left-right direction (i.e., X direction). The rear second wall 46*a* has a pair of rails 50. The pair of rails 50 is formed on the outer surface of the second wall 46*a*, and spaced apart from each other in left-right direction (i.e., X direction). The inner surface 50*a* (FIG. 2) of each rail 50 has a depressed groove (not shown) capable of engaging with a guide portion 64 of the lever 5, and a depression (not shown) locked with a projection 67 of a locking portion 65. The outer surface 50*b* of one rail 50 can engage with a rail-receiving portion 86 of the counter connector 3.

The pair of rotation shafts 47 is formed at the center or middle of the associated first wall 45. Each of the rotation shafts 47 has a cylindrical shaft portion 48 horizontally extending from the outer surface of the each first wall 45, and a flange portion 49 anteriorly projecting or extending from the tip or end portion of the cylindrical shaft portion 48. The lever 5 can be secured by sandwiching the lever 5 between the flange portion 49 and the first wall 45.

The second cylindrical portion 40 can be received in the counter housing 7. A watertight rubber stopper (not shown) can be inserted into the second cylindrical portion 40 so that the inner peripheral lip of the watertight rubber stopper comes in close contact with the outer periphery of the second cylindrical portion 40, as well as, the outer peripheral lip of the watertight rubber stopper comes in contact with the inner periphery of the counter housing 7. The second cylindrical portion 40 has a pair of first walls 38 spaced apart from each other and a pair of second walls 39 each extending from one edge of the associated first wall 38. Each of the first walls 38 extends in a front-back direction (i.e., Y direction). Each of the second walls 39 extends in a left-right direction (i.e., X direction).

With reference to FIG. 1, the lever 5 may include a pair of arm plate 51 spaced apart from each other, and an operating portion 52 coupled to the pair of arm plate 51. As such, the lever 5 may be formed in a horseshoe shape.

The arm plate 51 has a cam hole 53 passing the driven pin 8 of the counter connector 3 therethrough, a plate-shaped reinforcing piece 54 coupled to both ends of the cam hole 53 at the entrance or inlet of the cam hole 53, an annular hole 55 into which the rotation shaft 47 can be fitted, a sliding portion 59 projecting or extending from the reinforcing piece 54 toward the counter housing 7 and capable of sliding on a guiding member 73 of the counter housing 7, and an abutting portion 58 which abuts against the substrate 41 of the housing 4 in parallel with the substrate 41 when the lever 5 is horizontally inclined or rotated.

The cam hole 53 may include a curved portion 56 which is curved in a posterior direction as the lever 5 is inclined, and a straight portion 57 which is disposed at the ten. Anal end of the curved portion 56. Referring to FIG. 3, the entrance or inlet of the cam hole 53 into which the driven pin 8 is inserted is formed in the tip or end portion of the curved portion 56 at the stand-by state in which the operating portion 52 of the lever 5 is lifted up prior to the rotation of the lever 5. The cam hole 53 corresponds to a "cam portion" as described in the claims attached hereto. The cam hole 53 may be substituted with a cam groove (not shown).

Referring to FIG. 3, a depressed groove 53*a* is formed in the outer surface of the arm plate 51, and is specifically formed in the front side of the cam hole 53. The groove 53*a* can be formed corresponding to the trajectory or passage of the flange portion 82 of the driven pin 8 during the rotation of the lever 5. In other words, the groove 53*a* overlaps with the flange portion 82 of the driven pin 8.

As shown in FIG. 2, the reinforcing piece 54 is disposed in the tip or end portion of the lever 5, and is formed on the outer surface of the associated arm plate 51. The reinforcing piece 54 projects from the outer surface of the associated arm plate 51. In other words, the reinforcing piece 54 may be an outer wall which is disposed at the entrance or inlet of the cam hole 53 in the tip or end portion of the lever 5, and extends in a left-right direction (i.e., X direction). For reference, the pin extends in X direction.

Referring to FIG. 3, the sliding portion 59 is formed in the tip or end portion of the arm plate 51 at the stand-by state of the lever 5. The sliding portion 59 is located closer to the driven pin 8 to the reinforcing piece 54. In other words, the sliding portion 59 is disposed below the reinforcing piece 54. Due to this configuration, the sliding portion 59 can reach the tip or end portion of a guiding member 73 before the driven pin 8 proceeds into the cam hole 53. The tip or end portion of the guiding member 73 corresponds to a tapered surface 73*a*.

The annular hole 55 is formed adjacent to the straight portion 57. In other words, the annular hole 55 is formed adjacent to the terminal end of the cam hole 53. As shown in FIG. 3, a depressed groove 55*a* is formed in the outer surface of the arm plate 51, and specifically formed in the front side of the annular hole 55. The depressed groove 55*a* can be formed corresponding to the trajectory or passage of the flange portion 49 during the rotation of the lever 5. For reference, the flange portion 49 is formed in the rotation shaft 47 of the housing 4. The depressed groove 55*a* overlaps with the flange portion 49 of the rotation shaft 47.

There is provided a pair of the abutting portions 58. Referring to FIG. 1, each of the abutting portions 58 projects or vertically extends from the associated arm plate 51 toward each other. The abutting portion 58 is formed between the operating portion 52 of the arm plate 51 and the tip or end portion of the arm plate 51.

Referring to FIGS. 2 and 3, the operating portion 52 includes a horizontal substrate 51 coupled to the pair of the aim plates 51, a pair of side plates 62 vertically extending from both edges of the substrate 61 which are arranged in a right-left direction (i.e., X direction), and a top plate 63 coupled to the edges of the pair of the side plates 62. Each of the side plates 62 is shown to include a guide portion 64 engaging with a groove (not shown) formed in the rail portion 50 of the housing 4, and a locking portion 65 which can be received in a locking portion-receiving portion (not shown) formed in the inner surface of the rail portion 50.

Each of the guide portions 64 projects from the outer surface of the associated side plate 62. The guide portion 64 is farmed in a front-back direction (i.e., Y direction) over the entire length of the side plate 62.

Referring to FIG. 3, the pair of locking portions 65 is disposed below each guide portion 64. Each locking portion 65 includes a pair of slits 65*a*, an arm 66 formed between the pair of the slits 65*a*, and a projection 67 formed in the tip or end portion of the arm 66. The pair of slits 65*a* is disposed apart from each other, and extends in a front-back direction (i.e., Y direction) of the side plate 62. The slit 65*a* can be formed by cutting or omitting the front edge of the associated side plate 62. The projection 67 is formed on the outer surface of the arm 66.

Referring to FIG. 1, the counter connector 3 includes the counter housing 7 formed of synthetic resin, a terminal (not shown) such as a female terminal suited for being received in the counter housing 7 and connected to the afore-mentioned male terminal 21, and a flange portion 83 outwardly extending from the edge of the counter housing 7.

The counter housing 7 is cylindrically formed, and is defined by a pair of first peripheral walls 71, and a pair of second peripheral walls 72 coupled to the associated edge of the pair of the first peripheral walls 71. The counter housing 7 is made such that the dimension of the first peripheral wall 71 in a front-back direction (i.e., Y direction) is larger than the dimension of the second peripheral wall 72 in a left-right direction (i.e., X direction). In a planar view, the counter housing 7 is oval. For reference, the first peripheral wall 71 corresponds to a peripheral wall as described in the claims attached hereto.

The first peripheral wall 71 includes a guiding member 73 configured to guide the sliding portion 59 toward the outside of the first peripheral wall 71, the driven pin 8 being capable of slidably engaging with the cam hole 53 of the lever 5, and a rib 74 on which the inner surface 51*a* of the arm plate 51 slides. For reference, the rib 74 corresponds to a second guiding member as described in the claims attached hereto.

The guiding member 73 may have a guiding wall 73*b* formed in the center or middle of the first peripheral wall 71, and a plurality of rib bodies extending from the guiding wall 73*b* toward the flange portion 83.

The guiding wall 73*b* may vertically extend from or project from the outer surface of the first peripheral wall 71, and is made rectangular in its planar view. A tapered surface 73*a* may be formed adjacent to the sliding portion 59 at the tip or end portion of the guiding wall 73*b*. The tapered surface 73*a* is progressively inclined exteriorly or outwardly from the first peripheral wall 71 from the tip portion to the base portion (i.e., the flange portion 83).

The plurality of the rib bodies 73*c* is arranged in parallel to each other in a front-back direction (i.e., Y direction). The rib body 73*c* vertically extends from or projects from the outer surface of the first peripheral wall 71, and is made oval in its planar view. The rib body 73*c* has one end coupled to the guiding wall 73*b* and an opposite end coupled to the flange portion 83. The both ends (i.e., the one and the opposite ends) are defined in a longitudinal direction of the rib body 73*c* (i.e., Z direction). In other words, the longitudinal direction of the rib body 73*c* corresponds to a vertical direction (i.e., Z direction) in which the connector and the counter connector engage with each other.

Due to above rib configuration, the contact area between the rib body 73*c* or rib 74 and the inner surface 51*a* of the arm plate 51 can be reduced during the rotation of the lever 5. As a result, an operational capability (i.e., rotational capability) of the lever 5 required for coupling or decoupling the connectors can be largely reduced.

Each of the driven pins 8 includes a cylindrical shaft 81 horizontally extending from the outer surface of the guiding wall 73*a* of the guiding member 73, and a flange portion 82 upward projecting from the tip or end portion of the cylindrical shaft 81. The cylindrical shaft 81 is disposed below the tip or end portion of the guiding member 73. In other words, the tip or end portion of the guiding member 73 is located closer to the sliding portion 59 than the cylindrical shaft 81 of the driven pin 8. The flange portion 82 overlaps with the outer surface of the depressed groove 53*a* formed the outer periphery of the cam hole 53 so as to prevent the pair of arm plates 51 from moving or opening.

The plurality of ribs 74 is arranged in parallel to each other in a longitudinal direction of the first peripheral wall 71 (i.e., the front-back direction; Y direction). Each of the ribs 74 may vertically extend from or project from the outer surface of the cylindrical wall 71, and is made oval in its planar view. The rib 74 has a base portion and a tip portion along a longitudinal direction of the rib 74. The base portion is coupled to the flange portion 83 of the first peripheral wall 71, and the tip portion extends along the vertical direction (i.e., Z direction). Moreover, the rib 74 has a tip portion in which a tapered surface 74*a* is formed. The tapered surface 74*a* is progressively inclined in a direction away from the outer surface of the first peripheral wall 71 from the tip portion of the rib 74 to the base portion of the rib 74.

The flange portion 83 is made oval in its planar view, and has four corner portions each having a hole 84 for inserting a fixing bolt therethrough (see FIG. 1). The flange portion 83 can be directly attached or coupled to devices such as a motor and inverter of vehicle (not shown). Referring to FIGS. 2 and 3, the flange portion 83 has a fixture 85 for securing the bas bur electrically connected to the device thereto, and a rail-receiving portion 86 for engaging with the rail 50 of the housing 4. The fixture 85 may be disposed below the flange portion 83. The bus bar 9 may be L-shaped, and has its tip or end portion in which the afore-mentioned female terminal is disposed. The bus bar 9 overlaps with the fixture 85, and is secured to the fixture 85 by threading the bolt 89 into a nut (not shown) embedded in the fixture 85. The rail-receiving portion 86 is upwardly extends from the flange portion 83 and is approximately perpendicular to the flange portion 83. The rail-receiving portion 86 can be formed in the corner portion of the flange portion 83. Moreover, the rail-receiving portion 86 is made L-shaped by a wall portion 87 extending along the longitudinal direction of the flange portion 83 (i.e., a font-back direction; Y direction) and a wall portion 88 extending in the across-the-width direction (i.e., left-right direction; X direction).

A method of coupling the afore-mentioned connector 2 and counter connector 3 to each other will be hereinafter described in detail.

With reference to FIG. 3, the operating portion 52 of the lever 5 is lifted up in a state where the connector 2 is not coupled to the counter connector 3 or the connector 2 does not engage with the counter connector 3. As the connector 2 is put close to the counter connector 3, the sliding portion 59 of the connector 2 slides on the taper surface 73*a* of the guiding member 73. As a result, the sliding portion 59 is located on the guiding wall 73*b*. The reinforcing piece 54 of the arm plate 51 is guided or enlarged outwardly from the first cylindrical wall 71 by means of the sliding portion 59 and the guiding portion 73.

Referring to FIG. 3, when the lever 5 is rotated in a direction as indicated by an arrow "A" (i.e., backward rotation or anticlockwise rotation), the inner surface 51 of the arm plate 51 is slid onto the tapered surface 74*a* of rib 74. For reference, the tapered surface 74*a* is formed in the tip or end portion of the rib 74. As a result, the arm plate 51 is located on the rib 74, and the counter connector 3 is pulled along the cam hole 53 of the lever 5 in a vertical direction (i.e., Z direction). In practice, the counter connector 3 is generally fixed, and thus the connector 2 is pulled in a vertical direction (i.e., Z direction). As such, the driven pin 8 is located in the straight portion 57 of the cam hole 53, and the operating portion 52 of the lever 5 is substantially horizontally inclined in a backward direction simultaneously. In theses circumstances, the connector 2 and the counter connector 3 is securely coupled to each other.

When the connector 2 and the counter connector 3 are intended to be decoupled from each other, the lever 5 is rotated in a direction as indicated by an arrow "B"(i.e., forward rotation or clockwise rotation). As such, the connector 2 and the counter connector 3 are decoupled from each other in a front-back direction by the action or interaction between the cam hole 53 and the driven pin 8.

In accordance with the above embodiment, the sliding portion 59 is formed in the arm plate 51 of the lever 5 at the tip or end portion of the lever 5 which is situated in its stand-by state, and extends toward the counter housing 7. The guiding member 73 is formed on the outer surface of the first peripheral wall 71 such that the sliding portion 59 can slide on the guiding member 73, as well as, the guiding member 73 can guide the sliding portion 59 toward the outside of the first peripheral wall 71. As the housing 4 is put close to the counter housing 7, the sliding portion 59 is slid so as to run on the guiding member 73. As a result, the tip or end portions (i.e., the reinforcing pieces 54) of the pair of arm plates 51 are forced (i.e., pressed) to enlarge or extend in a direction away from each other. Due to this phenomenon, the lever 5 is avoided from inward collapse, and the tip or end portion of the arm plate 51 (i.e., the reinforcing piece) is located at the outside of the driven pin 8. Accordingly, the driven pin 8 can smoothly proceed into the cam hole 53 without being hindered or impeded by the tip or end portion of the arm plate 51 (i.e., the reinforcing piece 54).

In accordance with the embodiment of the invention, because the tip or end portion of the guiding member 73 is located closer to the sliding portion 59 than the shaft 81 of the driven pin 8, the sliding portion 59 can reach the tip or end portion of the guiding member 73 before the driven pin 8 proceeds into the cam hole 53. Accordingly, the advancement of driven pin 8 is not hindered or impeded by the tip or end portion of the lever 5.

In addition, the rib 74 (i.e., the second guiding member) is arranged in parallel to the guiding member 73 and the inner surface 51*a* of the arm plate 51 is configured to slide on the rib 74. Accordingly, even if the lever 5 is rotated, the inner surface 51*a* of the arm plate 51 is slid to run on the rib 74 and the overall aim plate 51 is located at the outside of the outer surface of the housing 4. Accordingly, any friction between the tip or end portion of the aim plate 51 and the outer surface of the housing 4 can be effectively avoided, thereby reducing the operational capability (i.e., rotational capability) of the lever 5 during the coupling or decoupling of the connectors.

In accordance with the above embodiment, at least one of the guiding member 73, the sliding portion 59, and the rib 74 (i.e., the second guiding member) has a tapered surface (73*a* or 74*a*) in its tip or end portion. Accordingly, the sliding portion 59 can slide on the tapered surface 73*a* of the guiding member 73 so as to gradually be located on or run on the tapered surface 73*a* of the guiding member 73. Alternatively, the guiding member 73 is slid on the tapered surface (not shown) of the sliding portion 59 such that the sliding portion 59 is gradually located on or run on the tapered surface of the guiding member 73. Alternatively, the inner surface 51*a* of the arm plate 51 is slid onto the tapered surface 74*a* of the rib 74 so as to gradually run on or be located on the tapered surface 74*a* of the rib 74. As such, the sliding portion 59 can run on or be located on the guiding member 73 with less force. Alternatively, the arm plate 51 can be located on or run on the rib 74 with less force.

In accordance with the above embodiment of the invention, the guiding member 73 has the tapered surface 73*a* in its tip or end portion. However, the invention is not limited to the above embodiment. In other words, the tapered surface may be formed in the sliding portion 59. The taper surface (not shown) formed in the sliding portion 59 may be disposed in the tip or end portion of the sliding portion 59. The tapered surface is progressively inclined in a direction approaching the inner surface of the arm plate 51 from the sliding portion adjacent to the reinforcing piece 54 to the tip or end portion of the arm plate 51. Alternatively, it is possible to omit the tapered surface 73*a* of the guiding member 73, as well as, the tapered surface of the sliding portion 59.

In accordance with the above embodiment, the rib 74 has the tapered surface 74*a* in its tip or end portion. However, the invention is not limited to the above embodiment. In other words, the rib 74 may or may not have such a tapered surface 74*a*.

In accordance with the above embodiment, the tip or end portion of the guiding member 73 can be located such that it is closer to the sliding portion 59 than the shaft 81 of the driven pin 8. In other words, the tip or end portion of the guiding member 73 is disposed above the shaft 81 of the driven pin 8. However, the invention is not limited to the above embodiment. Accordingly, the tip or end portion of the guiding member 73 may be disposed below the shaft 81 of the driven pin 8. In other words, the tip or end portion of the guiding member 73 may be located such that it is closer to the shaft 81 of the driven pin 8 than the sliding portion 59. In this case, the sliding portion 59 has a greater dimension in a direction toward the counter connector 7 (i.e., Z direction), and preferably reaches the tip or end portion of the guiding member 73 before the driven pin 8 proceeds into the cam hole 53.

While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A lever-equipped connector unit, comprising:

a housing being capable of receiving a terminal therein;

a lever rotatably coupled to the housing, and formed in a horseshoe shape, the lever being capable of rotation when the housing is in an engaged state with the counter housing and when the housing is in an unengaged state with the counter housing; and a counter housing being engageable with the housing, wherein the lever has a pair of arm plates configured to sandwich the housing therebetween and having a cam portion therein, wherein the counter housing has a peripheral wall engageable with the housing, and a pair of driven pins being slidably engageable with the cam portion and formed in the both outer surfaces of the peripheral wall, wherein the housing engages with the counter housing as the driven pin proceeds into the cam portion and the lever rotates from its stand-by state, wherein the arm plate of the lever has a sliding portion formed in a tip or end portion of the lever, which is situated in its stand-by state, and extending toward the counter housing, wherein the peripheral wall of the counter housing has a first guiding member thereon, and wherein the first guiding member is configured to slide the sliding portion of the arm plate, which collapse inward, thereon, as well as, to guide the sliding portion toward the outside of the peripheral wall.

2. The lever-equipped connector unit according to claim 1, wherein a tip or end portion of the first guiding member is made closer to the sliding portion than a shaft of the driven pin.

3. The lever-equipped connector unit according to claim 2, further comprising a second guiding member which is located in parallel to the first guiding member, wherein the inner surface of the arm plate is capable of sliding on the second guiding member.

4. The lever-equipped connector unit according to claim 3, wherein either of the first guiding member or the sliding portion has a tapered surface in its tip or end portion, or the second guiding portion has a tapered surface in its tip or end portion.

* * * * *